US006454109B1

(12) United States Patent
Doyle et al.

(10) Patent No.: US 6,454,109 B1
(45) **Date of Patent: *Sep. 24, 2002**

(54) CLOTHESLINE SYSTEM WITH A SUPPORT SYSTEM AND IMPROVED CLOTHESPINS

(75) Inventors: Noel Doyle, Alma; Steven Doyle, LaPlaine, both of (CA)

(73) Assignee: Productions Rexford-Doyle Inc., Laval (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/117,468

(22) PCT Filed: Dec. 1, 1997

(86) PCT No.: PCT/CA97/00923

§ 371 (c)(1),
(2), (4) Date: Oct. 2, 1998

(87) PCT Pub. No.: WO98/23805

PCT Pub. Date: Jun. 4, 1998

(30) Foreign Application Priority Data

Nov. 29, 1996 (CA) ..... 2191657

(51) Int. Cl.[7] ..... D06F 53/00

(52) U.S. Cl. ..... 211/119.01; 211/119.13; 211/119.09; 211/119.15; 211/124; 24/115 R

(58) Field of Search ..... 211/119.01, 119.11, 211/119.12, 119.13, 119.15, 119.09, 119.02, 119.03; 24/115 R, 134 Q, 129 R, 130, 115 K; 160/178.1, 178.2; 254/394

(56) References Cited

U.S. PATENT DOCUMENTS

| | | | | | |
|---|---|---|---|---|---|
| 148,088 | A | * | 3/1874 | Reid et al. | 211/119.13 X |
| 379,113 | A | * | 3/1888 | Hibberd | 254/394 X |
| 567,800 | A | * | 9/1896 | Yung | 211/119.09 |
| 606,363 | A | * | 6/1898 | Sinnott | 211/119.02 X |
| 816,664 | A | * | 4/1906 | Johnson | 211/119.09 |
| 884,680 | A | * | 4/1908 | Polakoskey | 211/119.13 X |
| 980,017 | A | * | 12/1910 | Short | 211/119.11 |
| 1,222,510 | A | * | 4/1917 | Zirkle | 211/119.13 X |

(List continued on next page.)

*Primary Examiner*—Daniel P. Stodola
*Assistant Examiner*—Khoa Tran
(74) *Attorney, Agent, or Firm*—Clifford W. Browning; Woodard, Emhardt, Naughton, Moriarty & McNett

(57) ABSTRACT

A clothesline system is provided for automatically applying clothespins to articles to be dried once they are placed on a clothesline. The clothesline system comprises first and second pulleys, which are positioned at a spaced apart distance from each other, as well as a main cable, a secondary cable and a plurality of clothespins. The clothespins are capable of being removably attached to the secondary cable, and are movable between an open and closed position for receiving and gripping articles to be dried to the main cable. The clothesline system further comprises a mechanism for automatically opening and closing the clothespins so that they are able to either selectively grip or release the articles to be dried. Finally, the clothesline system comprises a support system for guiding and supporting the main cable such that the main cable is prevented from sagging beyond an acceptable distance within which the clothespins are capable of being attached to the main cable.

11 Claims, 4 Drawing Sheets

U.S. PATENT DOCUMENTS 1,335,331 A * 3/1920 Gunderson ..... 211/119.13 X
1,368,839 A * 2/1921 Richards ..... 211/119.13
1,386,199 A * 8/1921 Perovich ..... 211/119.11
1,400,142 A * 12/1921 Cyr ..... 211/119.09
1,775,253 A * 9/1930 Perebenda ..... 211/119.02
1,793,330 A * 2/1931 Magnant ..... 24/129 R
1,861,282 A * 5/1932 Nelson ..... 211/119.02
2,056,481 A * 10/1936 Pauli ..... 211/119.02
2,201,831 A * 5/1940 Jacque ..... 211/119.09
2,269,824 A * 1/1942 McCormack ..... 211/119.01 X
2,483,692 A * 10/1949 Day ..... 211/119.09
2,815,864 A * 12/1957 Alexander ..... 211/119.02
2,976,593 A * 3/1961 Exton ..... 211/119.12 X
3,314,120 A * 4/1967 Minogue ..... 24/137
3,656,630 A * 4/1972 Miguel ..... 211/119.11
3,712,556 A * 1/1973 Bosco ..... 242/100
3,791,070 A * 2/1974 Roberts ..... 211/119.01 X
3,897,161 A * 7/1975 Reinwall, Jr. ..... 24/115 R X
3,993,197 A * 11/1976 Tann ..... 211/119.09
4,367,830 A * 1/1983 Jacquith et al. ..... 224/258
4,446,996 A * 5/1984 Garrison ..... 211/119.13 X
4,519,509 A * 5/1985 Doyle ..... 211/119.13
4,566,157 A * 1/1986 Packendorff ..... 24/536
4,640,281 A * 2/1987 Sturm et al. ..... 128/327
4,876,771 A * 10/1989 Givati ..... 211/119.31 X
4,919,370 A * 4/1990 Martin et al. ..... 24/129 R X
5,473,797 A * 12/1995 Wu ..... 24/115 R X
5,504,977 A * 4/1996 Weppner et al. ..... 24/115 R
5,683,073 A * 11/1997 Pickrell ..... 254/134.3
5,802,679 A * 9/1998 Neeley ..... 24/130

* cited by examiner

CLOTHESLINE SYSTEM WITH A SUPPORT SYSTEM AND IMPROVED CLOTHESPINS

FIELD OF THE INVENTION

The present invention relates to a clothesline system that can automatically secure clothes onto a main clothes cable without having to manually do so with clothespins. A distinguishing feature of the clothesline system resides in the provision of a support member that prevents the main cable from sagging beyond a predetermined distance from a secondary cable while under the effect of the clothes weight. The secondary clothes cable comprises improved clothespins that can be used wit the clothesline system to engage the main cable and that feature multiple clothes holding positions. The invention also extends to a cable connector element that allows one section of a continuous cable to form the main cable and a second section of the continuous cable to form the secondary cable. As a result, the main cable is continuous with the secondary cable.

BACKGROUND OF THE INVENTION

Typical clothesline systems provide a support on which wet clothes are placed to dry. The clothesline system includes a continuous cable that extends between two pulleys. The cable provides the support on which to hang the wet clothes and in order to see clothes onto the cable, clothespins must be manually placed thereon. These clothespins must be manually removed and stored when the clothes are dry and ready to be removed from the clothesline system.

To overcome the cumbersome operation of manually inserting and removing each clothespin, U.S. Pat. No. 4,519,509 issued on May 28, 1985, provides a means for automatically presenting clothespins onto the clothes cable to secure the clothes and a means for automatically removing the clothespins from the dry clothes. The clothesline system as disclosed in this reference includes an endless main cable extending between two pulleys. A pin lay wheel located between the two pulleys has a number of V-shaped recesses for receiving a series of clothespins on a secondary cable that engage the main cable while in a normally closed position. The ends of the secondary cable are attached to the main cable and when the main cable is displaced the secondary cable is moved in unison to bring the pins secured thereon in engagement with the pin lay wheel. The pins are automatically opened thus releasing the main cable which allows them to travel over an arched path defined by the periphery of the lay wheel. Further rotation of the main cable causes the pins to reengage a run of the main cable on which wet articles of clothing are placed. As a result, the articles of clothing are secured on the main cable.

Although the system facilitates securing the clothes onto the clothesline system, it fails to provide a means for preventing the main cable from sagging beyond an acceptable range within which the pins can engage the cable and secure the clothes that are placed to dry. More specifically, upon placing clothes onto the main cable, the main cable will tend to accordingly pull away from the secondary cable. In some instances however the clothes will pull the main cable under the effect of gravity at an appreciable distance from the secondary cable which will place it beyond a distance within which a pin can engage the main cable. Moreover, the clothespins described in this reference are designed with only one clothes holding position, thus limiting the range within which the clothes cable may sag away from the secondary cable.

Thus there is a need in the industry to provide a clothesline system with a support system that maintains the distance between the main cable and the secondary cable within an acceptable range. In addition, there is a need to provide clothespins with multiple clothes holding positions for successfully engaging articles of clothing placed over the main cable.

OBJECTIVES AND STATEMENT OF THE INVENTION

It is an object of the invention to provide a clothesline system with a support member capable of maintaining the main cable within an acceptable range from the secondary cable.

It is a further object of the invention to provide clothespins for use with a clothesline system that are capable of multiple clothes holding positions.

It is another object of the invention to provide a clothesline system wherein the main cable is continuous with the secondary cable.

It is another object of the invention on to provide a novel cable connector element capable of establishing one section of a continuous cable as the main cable and a second section of the same continuous cable as the secondary cable.

In a preferred embodiment, the clothesline system comprises a main clothes cable that extends between two spaced apart pulleys. The cable has at upper run and a lower run. A support member being located between the two runs includes an upper support arm and a lower support arm. A clothespin lay wheel is mounted at the extremity of the upper support arm so that it is in the plane of the two runs. The lay wheel has a V-shaped recess to receive a secondary cable on which is attained a series of clothespins. The clothespins engage the main cable in a normally closed position. The ends of the secondary cable are attached to the main cable so as to move in unison with the main cable. Upon rotation of the main cable, the closed pins register with the recess of the sprocket wheel and automatically open. Thus, the clothespins release the main cable and travel along an arched path defined by the periphery of the lay wheel. Further rotation of the main cable causes the clothespin to re-engage the run of the main cable on which articles of closeting are placed. Advantageously, the support member will prevent the main cable from deflecting beyond the distance within which the clothespins can successfully engage the main cable at different holding positions.

In the realization described above, the secondary cable is a separate cable, attached to the main cable. In a variant, the main cable and the secondary cable are continuous with one another. A cable connector element establishes one section of a continuous cable to form the main cable and a second section of the same continuous cable to form the secondary cable.

DESCRIPTION OF A PREFERRED EMBODIMENT

Figure 1:
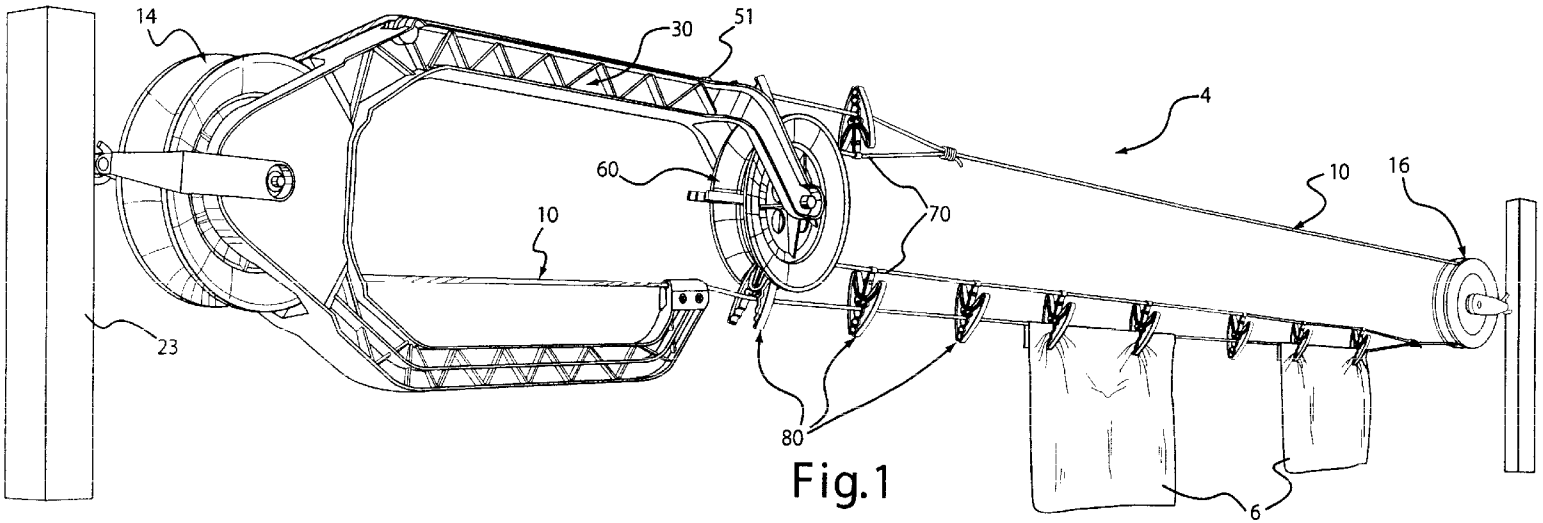
FIG. 1 is a perspective view of the clothesline system in accordance with the present invention.

Referring now to the drawings, FIG. 1 illustrates a clothesline system 4 on which articles of clothing 6 are placed to dry. Broadly stated, the clothesline includes a main cable 10 supported between two spaced apart pulleys 14 and 16 and a support member 30 to which pulley 14 is mounted. A pin lay wheel 60, also mounted to the support member 30, is provided to deposit clothespin 80, which are attached to a secondary cable 70, onto articles of clothing 6 that may be placed on the main cable 10.

The main cable 10 is a continuous cable whose ends are attached to establish two continuous runs between pulleys 14 and 16, namely a lower run 12' and an upper run 12". Pulley 14 is rotatably mounted to support member 30 which in turn is attached to a bracket 17 that is pivotally attached to a support structure 23. Pulley 16 is rotatably mounted to bracket 18 that is pivotally attached to support structure 24 that is at a spaced apart distance from support structure 23.

Figure 2:
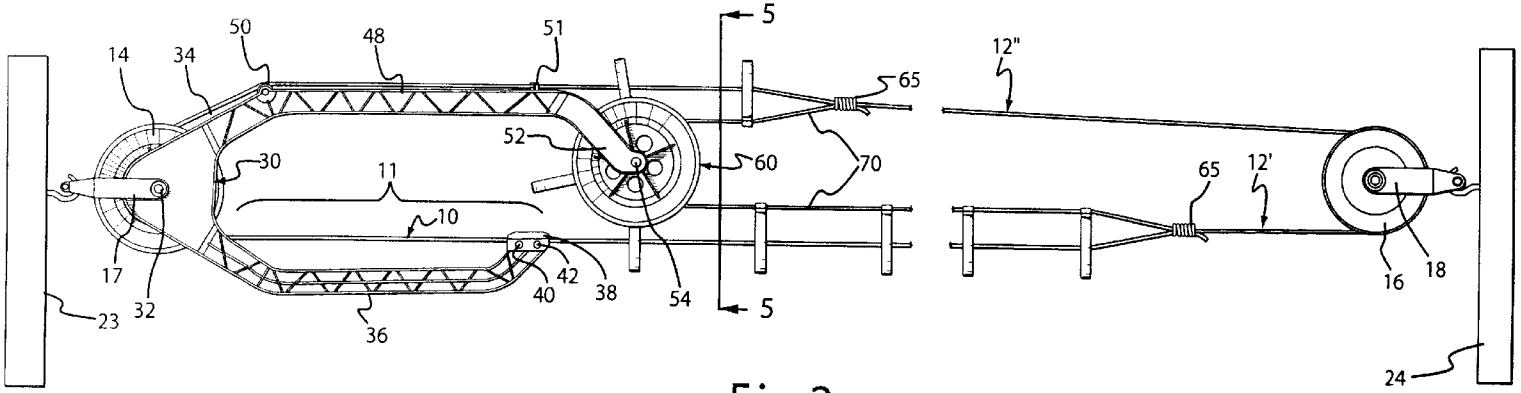
FIG. 2 is a side elevational view of the clothesline system, some elements being removed for clarity.

As best seen in FIG. 2, the support member 30 comprises apertures 32 through both of its side walls to receive a pin which establishes the pivotal axis for pulley 14 and serves to secure bracket 17 that provides a connection point with support structure 23. A recess 34 provided between the walls on which apertures 32 are formed, receives pulley 14 and allows it to rotate freely therein.

The support member 30 includes two distinct reinforced arms that originate at the side walls between which pulley 14 is mounted, namely, a lower support arm 36 and an upper support arm 48. The lower support arm 36 includes three continuous segments: a first oblique segment which extends beyond pulley 14 and run 12', a second horizontal intermediate segment which extends parallel to the cable's tangential axis with pulley 14 and a final segment that extends upward tangential to pin lay wheel 60 to be described later. A guide 38 is provided at the extreme end of the third segment to receive cable 10 and support it along an axis that is tangent to that of pulley 14. The guide 38 includes two mating components that when fastened with screws 40 and 42 provide a channel through which cable 10 can slide freely. In effect, the lower support arm 36 provides support along a span 11 of run 12' on which clothes 6 may be freely placed. This span 11 extends closely to the pin lay wheel 60.

Figure 5:
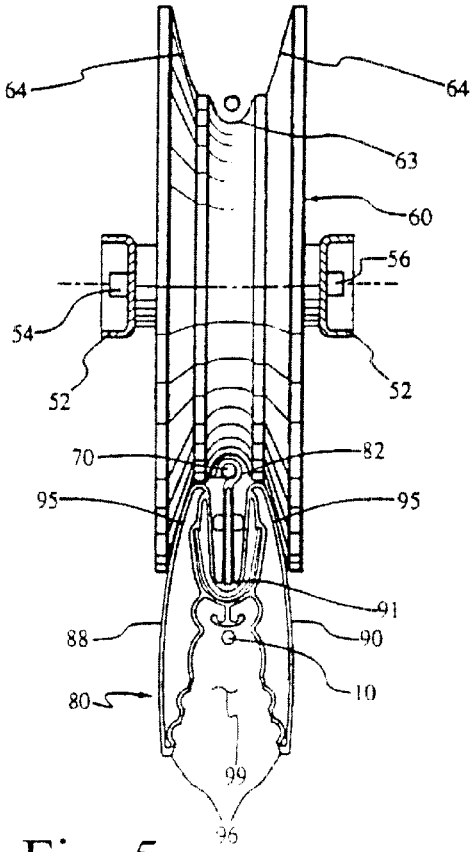
FIG. 5 is a cross section taken long line 5—5 in FIG. 2 showing two clothespins engaged in the pin lay wheel.

The upper support arm 48 also includes three continuous segments; a first oblique segment extending beyond pulley 14 and guiding run 12", a second segment extending along run 12" and a final segment extending between runs 12' and 12", past the extremity of guide 38. A guide member 51 projects beyond the surface of the second segment and includes an aperture through which cable 10 extends and can slide freely. The guide member 51 maintains the cable 10 along the outer surface of the second segment of support arm 48 so as to direct it onto a bearing 50 that provides a rolling contact surface guiding cable 10 toward the pulley 14. The third segment of the upper support arm 48 is a fork 52 that supports pin lay wheel 60. The fork 52 includes two parallel spaced apart members, each with respective apertures 54 through which a pin 56, shown in FIG. 5, is inserted to rotatably support the pin lay wheel 60 which is preferably the same diameter as pulleys 14 and 16. The fork 52 orients pin lay wheel 60 in the plane defined by pulleys 14 and 16 at a distance relatively close to run 12'.

Pin lay wheel 60 includes a circumferential groove 63 with two radially projecting side wall 64. The side walls 64 progressively widen radially outward to receive therebetween and progressively open a series of normally closed pins 80 that are carried by a secondary cable 70 and whose ends 65 are attached to the main cable 10 by means well known to those skilled in the art. In this embodiment, the secondary cable 70 is a separate cable from the main cable 10.

Figure 3:
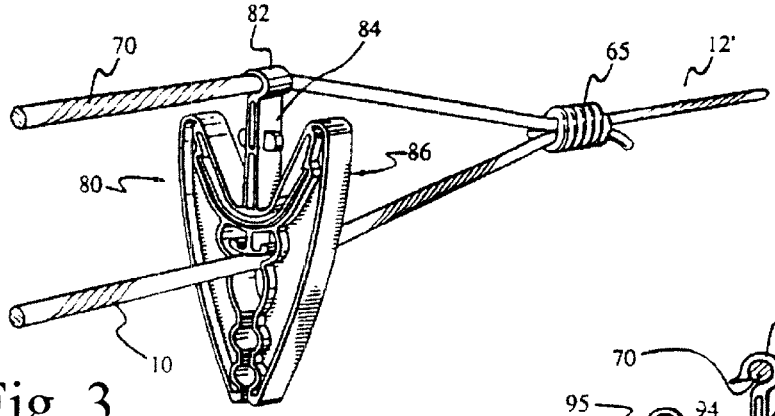
FIG. 3 is a perspective view of a clothespin in accordance with the invention.
Figure 4:
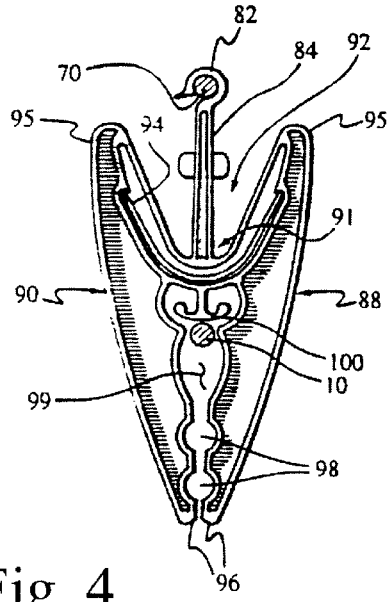
FIG. 4 is a side elevational view of the clothespin.

As best illustrated in FIGS. 3 and 4, each clothespin 80 comprises three parts, namely, a head 82, a neck 84 and a body 86. Head 82 is a hook configured member that can be frictionally attached onto the secondary cable 70. The head is resilient so it can be readily detached from the secondary cable 70 if desired. The ability to readily remove and install the head is convenient because the clothespins 80 may be installed after the clothesline system has been assembled. This also allows to place a desired number of clothespins 80 anywhere along the secondary cable, contrary to the system disclosed in the previously referred patent where the pins are not removable. The neck 84 is a linear member that connects head 82 with body 86 so as to support the latter on the secondary cable 70. The body 86 is a flat jaw like member having two legs 88 and 90 that are pivotally connected by a hinge area 91. The hinge area defines a cavity 92 around neck 84 that extends from one leg to the other. A C-shaped spring biasing member 94-urges legs 88 and 90 to close, such that tips 96 of each leg abut one another. The inner surfaces of the leas that face one another below the hinge area 91 and above tips 96 provide a channel 99 within which multiple holding positions of cable 10 (including articles of clothing thereon) are possible relative the hinge area 91. The channel 99 includes a plurality of recesses 98 for selectively receiving the main cable 10 at different holding positions. In a variant, the channel 99 can be substantially of uniform width while still providing multiple holding positions for cable 10. The channel establishes the acceptable distance within which the main cable 10 can sag while being engageable by the clothespin 80. Upon engaging the cable 10 and closing channel 99, the cable is held in one of different holding positions from the hinge area 91. A support 100 provides a top wall against which the main cable 10 or clothes 6 can abut upon entering channel 99. Accordingly, the top wall support 100 maintains a minimum clearance between the main cable 10 and the secondary cable 70.

As the main cable 10 is manually pulled, secondary cable 70 attached to the main cable 10 is caused to move in the same direction. As best seen in FIG. 5, the head 82 of each clothespin 80 subsequently registers in groove 63 of pin lay wheel 60 and draws body 86 radially inward along the side walls 64 of the wheel. As pins 80 enter between the side walls 64 of pin lay wheel 60, pressure is progressively applied on the upper extremity 95 of legs 88 and 90 which causes them to pivot on the hinge area 91 and accordingly pivot abutting tips 96 apart, thus opening channel 99. As best illustrated in FIG. 1, the opened clothespins 80 disengage themselves from the main cable 10, the pin is brought toward run 12' such that cable 10 enters the opened cavity 99 while tips 96 are still apart. In accordance with the invention, support arm 36 will prevent the main cable 10 from sagging beyond the acceptable distance within which the clothespins 80 can successfully engage the main cable 10 at different holding positions along channel 99. The clothespins 80 and support member 30 are preferably manufactured by injection moulding and are reinforced by fibers.

Figure 7:
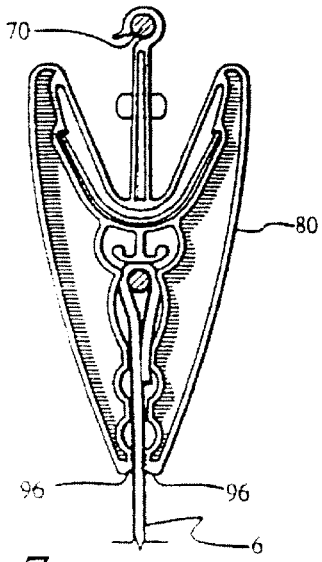
FIG. 7 is a cross-section taken along line 7—7 in FIG. 6.
Figure 6:
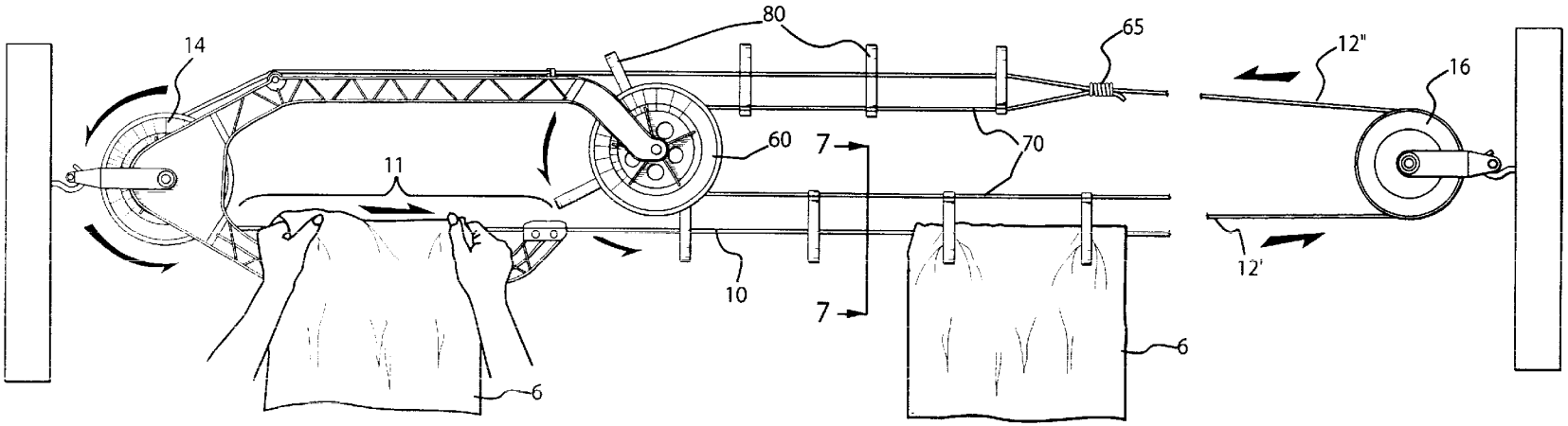
FIG. 6 is a side view of the clothesline system showing the placement of an article of clothing onto the main clothes cable.

In operation, to dry clothes on clothesline system 4, articles of clothing 6 are respectively placed over the supported span 11 of run 12'. As illustrated in FIG. 6, the main clothes cable 10 is then pulled in a direction shown by the arrow which respectively causes secondary cable 70 to carry clothespins 80 alone the arched path defined by the pin lay wheel 60. Accordingly, the clothespins automatically open to release cable 10 of run 12" and re-engage cable 10 of run 12'. Upon exiting the pin lay wheel 60 the clothespins 80 are automatically closed over cable 10 and secure respective articles of clothing 6 placed on run 12' at one of several possible holding positions provided along channel 99 as seen in FIG. 7.

When the clothes are dry, the main cable 10 is pulled in the opposite direction so as to release clothespins 80 that secure the articles of clothing 6 along run 12'. More specifically, secondary cable 70 which moves in unison with the main cable 10, carries the clothespin 80 along the path defined by pin lay wheel 60 which causes the pins to automatically open, thus disengaging from the article of clothing 6 on run 12' and thus engaging main cable 10 of run 12".

In the above description, the secondary cable 70 is a separate cable that is attached to the main cable to form a synchronized structure. In a variant, the main cable 10 and the secondary cable 70 are continuous with one another. Two cable connector elements 110' and 110" allow one section of a continuous cable 8 to form the main cable 10 and a second section of the continuous cable 8 to form the secondary cable 70.

Figure 8:
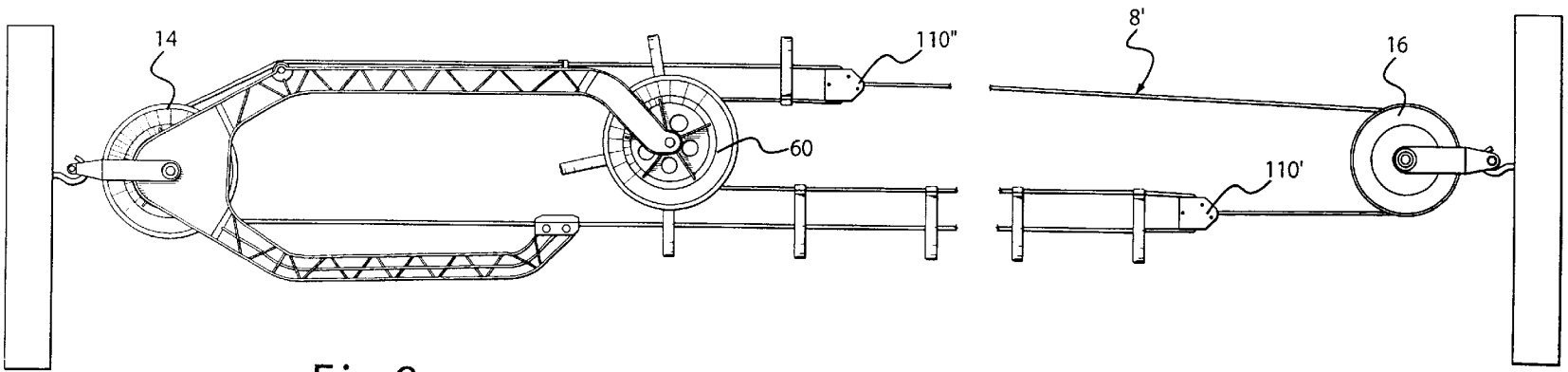
FIG. 8 is a side view of a clothesline system constructed in accordance with a variant that incorporates cable connecting elements.
Figure 10A:
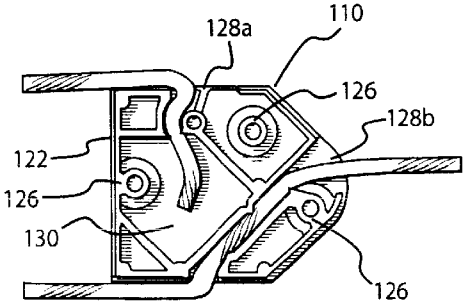
FIG. 10A is a view of the inside of the connecting element shown in FIG. 9, with a continuous cable placed therein.
Figure 9:
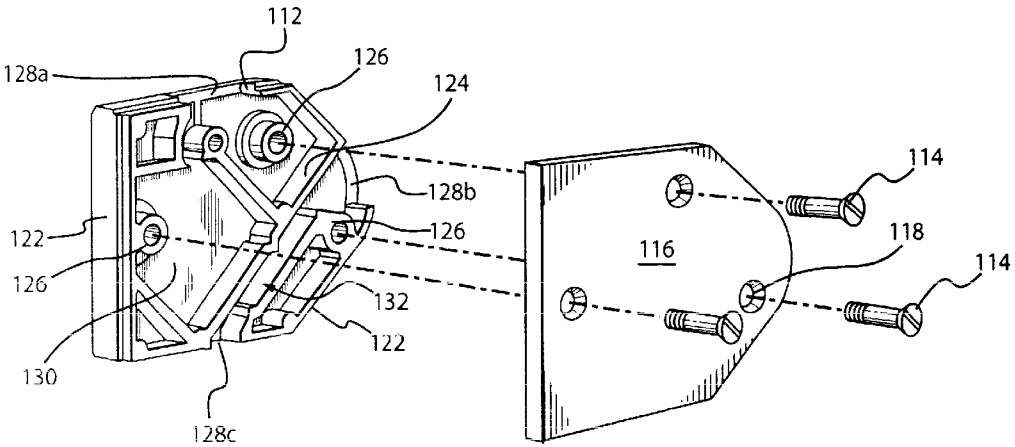
FIG. 9 is an exploded perspective view of the cable connecting element.

The clothesline system 4 as illustrated in FIG. 8 comprises all the structure and functional elements as described above with the addition of two novel cable connector elements 110' and 110". As best illustrated in FIG. 9 each cable connector 110 includes two mating plates 112 and 116. Generally stated, plate 112 comprises outer walls 122, partition walls 124, support posts 126 and apertures 128*a*, 128*b* and 128*c*. The outer walls 122 define the shape of the plate which in this particular case is a square body with a pointed extension at one of its sides. The partition walls 124 are provided within the boundary established by walls 122 to define a cavity 130 for receiving one end of the continuous cable 8 and a channel 132 for engaging a segment of the continuous cable 8. The partition walls provide a number of projections for pricking the continuous cable 8 at various locations along channel 132 and at the entrance to cavity 130 to secure the cable therein. Apertures are provided on walls 122 to allow cable 8 to enter cavity 130 and channel 132 while the two plates 112 and 116 are secured thereon. More specifically, aperture 128*a* communicates with cavity 130 while 128*b* and 128*c* communicate with channel 132. Plate 116 is a flat member that is identical in shape to plate 112. It includes three apertures 118 that align with support posts 126 of plate 112 that provide an aperture through which screws 114 are threadedly engaged to fasten the two plates 112 and 116 together. Accordingly, the end of the continuous cable 8 that extends through aperture 128*a* is secured into cavity 130 while the segment of the continuous cable that extends between apertures 128*b* and 128*c* are secured within channel 132.

Figure 10:
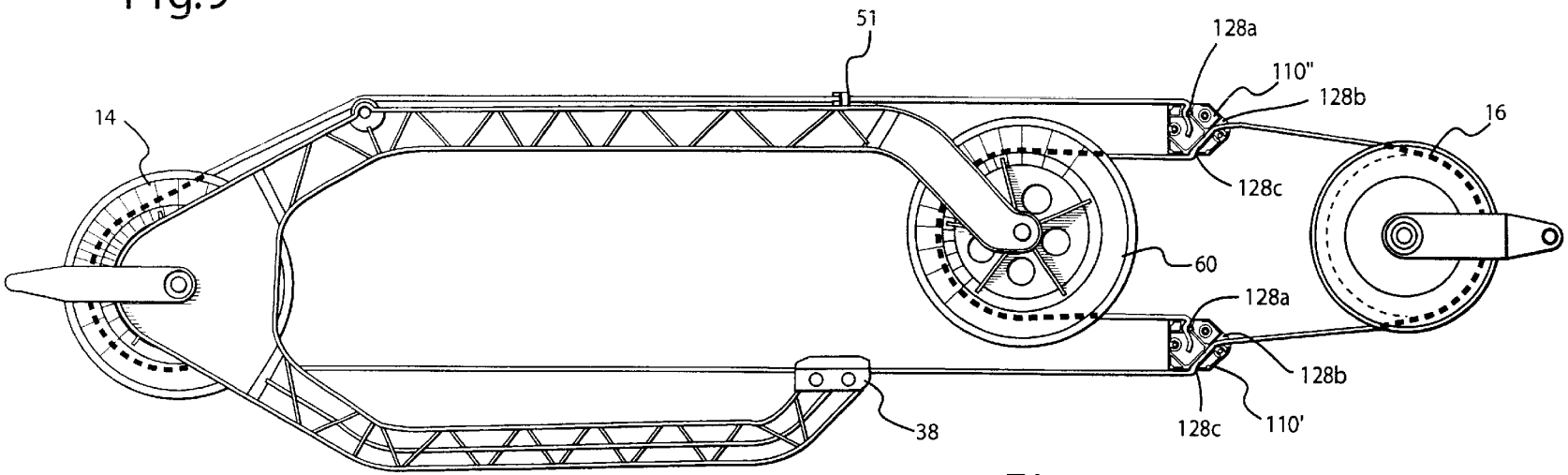
FIG. 10 is an enlarged vertical cross sectional view of the clothesline system shown in FIG. 8.

As best illustrated in FIG. 10, the two cable connector elements 110' and 110" create two cable runs from one continuous cable 8, namely the main cable 10 and the secondary cable 70. More specifically, the main cable 10 is defined as the section of the continuous cable 8 whose end is secured within cavity 130 of connector element 110" and extends out through aperture 128*a*, along pulley 14, passes through channel 132 of connector element 110', passes over pulley 16 and extends into aperture 128*b* of connector element 110". The remaining portion of the continuous cable 8 defines the secondary cable 70. More particularly, the secondary cable 70 is the section of the continuous cable 8 extending from aperture 128*c*, travelling along the periphery of pin lay wheel 60 and whose end is secured into cavity 130 of cable connector element 110'.

The above description of the preferred embodiment should not be interpreted in any limiting manner since variations and refinements are possible which are within the spirit and scope of the present invention. The scope of the invention is defined in the appended claims and their equivalents.

What is claimed is:

1. A clothesline system suitable for supporting articles to be dried, said clothesline system comprising:

a first pulley and a second pulley, said first pulley being positioned in a spaced apart relationship from said second pulley;

a main cable portion and a secondary cable portion:

a) said main cable portion forming a loop between said first pulley and said second pulley, said loop defining an upper run and a lower run;

b) said secondary cable portion having a first ending portion and a second ending portion, said first ending portion extending from said upper run and said second ending portion extending from said lower run;

a plurality of clothespins on said secondary cable portion, said clothespins can be operated between an opened position and a closed position, wherein in the opened position said clothespins being capable to accept articles to be dried, and wherein in the closed position said clothespins being capable to secure the articles to be dried to said main cable portion;

a clothespin dispensing device for placing clothespins around said main cable portion;

a support system having an upper support arm and a lower support arm, said upper support arm extending along said upper run between said first pulley and said clothespin dispensing device, said lower support arm extending along said lower run from said first pulley toward said clothespin dispensing device and engaging said lower run in close proximity to said clothespin dispensing device, thereby preventing said main cable portion from sagging beyond a distance within which said clothespin dispensing device can place clothespins around said main cable portion.

2. A clothesline system as defined in claim 1, wherein each clothespin has an attachment portion and a gripping portion, said attachment portion adapted to be removably secured to said secondary cable portion, said gripping portion having a first leg and a second leg adapted to be moved one with relation to the other to change the condition of the clothespin between the opened position and the closed position, in the opened position said first and second legs are spaced apart to accept articles to be dried, and in the closed position said first and second legs clamp articles to be dried onto said main cable portion.

3. A clothesline system as defined in claim 2, wherein said clothespin dispensing device comprises a clothespin lay wheel having a periphery, said clothespin lay wheel having a groove along said periphery to engage said clothespins and bring the clothespins to the opened position.

4. A clothesline system as defined in claim 2, wherein said clothespin lay wheel is mounted to said support system and is located between said upper and lower runs of said main cable portion.

5. A clothesline system as defined in claim 4, wherein said support system is located in the vicinity of said first pulley so as to support said main cable portion along the portion of said upper and lower runs adjacent said first pulley.

6. A clothesline system as defined in claim 5, wherein said upper support arm and said lower support arm of said support system have mutually parallel and rectilinear segments that extend along said upper run and said lower run, said clothespin lay wheel being mounted at one end of said upper support arm and said first pulley being mounted adjacent an extremity of said upper support arm and said lower support arm at a spaced apart distance from said clothespin lay wheel.

7. A clothesline system as defined in claim 6, wherein said upper support arm and said lower support arm support said upper and lower runs of said main cable portion at a predetermined distance from said clothespin lay wheel.

8. A clothesline system as defined in claim 1, wherein said main cable portion and said secondary cable portion are formed from one continuous cable having a first end, a second end and a length of cable in between.

9. A clothesline system as defined in claim 8, having connector means for forming from said continuous cable said main cable portion and said secondary cable portion.

10. A clothesline system as defined in claim 9, wherein said connector means comprises two cable connector elements, namely a first connector element and a second connector element, each of said cable connector elements providing a cavity for receiving and securing one end of said cable and a channel through which a section of said cable is traveled through.

11. A clothesline system as defined in claim 10, wherein said first end of said cable is secured in said cavity of said first cable connector element, and said second end of said cable extends through said channel of said second connector element, then extends through said channel of said first connector element, and finally said second end of said cable is secured in said cavity of said second connector element.

* * * * *